US005987788A

United States Patent [19]

Doyel

[11] Patent Number: 5,987,788

[45] Date of Patent: Nov. 23, 1999

[54] REMOVABLE TEFLON COVER FOR THE SOLE PLATE OF A FABRIC PRESSING IRON

[76] Inventor: John S. Doyel, 404 W. 20th St., New York, N.Y. 10011

[21] Appl. No.: 09/030,331

[22] Filed: Feb. 25, 1998

[51] Int. Cl.[6] ..... D06F 75/38

[52] U.S. Cl. ..... 38/97

[58] Field of Search ..... 38/97, 93, 81, 38/69, 74, 75, 79, 80; 219/275, 254; 150/157, 165, 901

[56] References Cited

U.S. PATENT DOCUMENTS

| | | | |
|---|---|---|---|
| 2,458,530 | 1/1949 | Resnick . | |
| 2,743,542 | 5/1956 | Drummond | 38/97 |
| 2,750,697 | 6/1956 | Jacobson . | |
| 2,990,635 | 7/1961 | Rodgers . | |
| 3,121,965 | 2/1964 | McBride | 38/97 |
| 3,142,916 | 8/1964 | Jacobson . | |
| 3,257,746 | 6/1966 | Cohen . | |
| 3,404,471 | 10/1968 | Wilsker et al. . | |
| 3,407,521 | 10/1968 | English . | |
| 3,905,138 | 9/1975 | Abolafia . | |
| 3,930,325 | 1/1976 | Schaeffer et al. . | |
| 4,209,921 | 7/1980 | Kochauf . | |
| 4,642,922 | 2/1987 | Prudenziati . | |
| 4,660,307 | 4/1987 | Fay . | |
| 4,665,637 | 5/1987 | Kramer . | |
| 4,747,222 | 5/1988 | Riba . | |
| 4,800,661 | 1/1989 | Yamamoto et al. . | |
| 4,856,212 | 8/1989 | Dikoff . | |
| 5,164,244 | 11/1992 | Mattesky . | |
| 5,165,184 | 11/1992 | Gardaz et al. . | |
| 5,165,185 | 11/1992 | Gardaz et al. . | |
| 5,664,349 | 9/1997 | White et al. . | |

FOREIGN PATENT DOCUMENTS

| | | | |
|---|---|---|---|
| 1372591 | 5/1963 | France | 38/97 |
| 2753372 | 7/1978 | United Kingdom | 38/97 |

*Primary Examiner*—Ismael Izaguirre
*Attorney, Agent, or Firm*—Cooper & Dunham LLP

[57] ABSTRACT

A removable cover of a PTFE or similar material for a fabric pressing iron has steam holes punched and stretched to a form spacing the cover from the sole plate of the iron and facilitating the efficient delivery of steam from the iron to the material being ironed. The cover has a pocket for the tip of the iron which is formed by folding over a part of a flat sheet of PTFE and bringing the lateral edges of the fold line together and securing them by inserting a cotter pin between the flap and underlying PTFE material, and has hook-and-loop strips attached to its back to help secure the cover to the iron removably and maintain it in place during ironing.

10 Claims, 5 Drawing Sheets

REMOVABLE TEFLON COVER FOR THE SOLE PLATE OF A FABRIC PRESSING IRON

BACKGROUND AND SUMMARY OF THE INVENTION

The invention pertains to using an iron generating heat and steam for tasks such as pressing sheet material such as fabric. Such irons have been used for a long time. A typical contemporary iron has an electric heating element and often, although not always, a water container and the ability to generate steam issuing from a pattern of holes in its sole plate. The sole plate typically is metal and often is coated with a slippery material such as Teflon or other PTFE substances.

There have been proposals for supplying such irons with a removable sole plate cover made of a slippery and heat resistant material that is considerably thicker than the typical fixed coating of the same or similar material on the sole plate of some irons. One proposal is discussed in U.S. Pat. No. 5,664,349 and others are discussed in references cited on the face of the patent and in its columns 2–4. It is believed that covers similar to that discussed in the patent are, and have been for some time, on sale in this country. The patent states that the removable cover is flat, with no protuberances, and is "adapted to provide direct, continuous, unbroken contact with the sole plate of the iron and completely thereover . . . excepting said steam vent holes of said cover and any steam vent holes of the sole plate." One difficulty with such covers is that because of the wide variety of patterns of steam holes in the sole plate of irons, it cannot be expected that the steam holes in the removable cover will match those in the sole plate of the iron. As a result of a mismatch, there can be inefficient delivery of steam to the fabric or other material being ironed. An earlier U.S. Pat. No. 4,209,921 proposes a removable Teflon cover that would have collars at the steam vent holes and ridges elsewhere to thereby vertically space the major upper surface of the cover from the sole plate of the iron. However, if those collars and ridges are not formed from a flat sheet of PTFE by a simple process but require specially molded material or material formed from a flat sheet through an expensive treatment, they can add unreasonable expense to the product.

In order to provide a good balance between effectiveness and cost, the removable sole plate cover disclosed herein uses a flat sheet of a material such as PTFE (Teflon) but spaces it from the sole plate of the iron by punching and stretching the steam holes in the cover in a process that created protuberances at the upper edges of the holes. The inventor has discovered that the protuberances that this punching and stretching creates are sufficient to maintain enough of that major surface spaced from the sole plate of the iron while pressing is carried out and is further sufficient to facilitate efficient delivery of steam to the material being ironed even when there is poor vertical alignment between steam holes in the sole plate and in the removable cover. In addition, the inventor has discovered a particularly effective and inexpensive way to form the sheet material of the cover into a pocket matching the tip of the iron, and a particularly effective and flexible way to removably attach the cover to the iron and maintain it in place during ironing.

DETAILED DESCRIPTION

Figure 2:
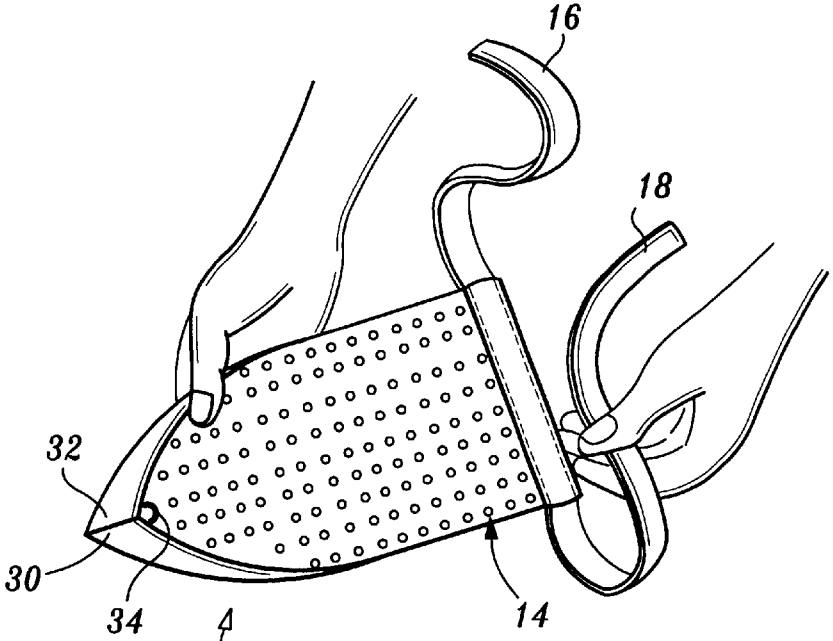
FIG. 2 is a perspective view of the cover.
Figure 1:
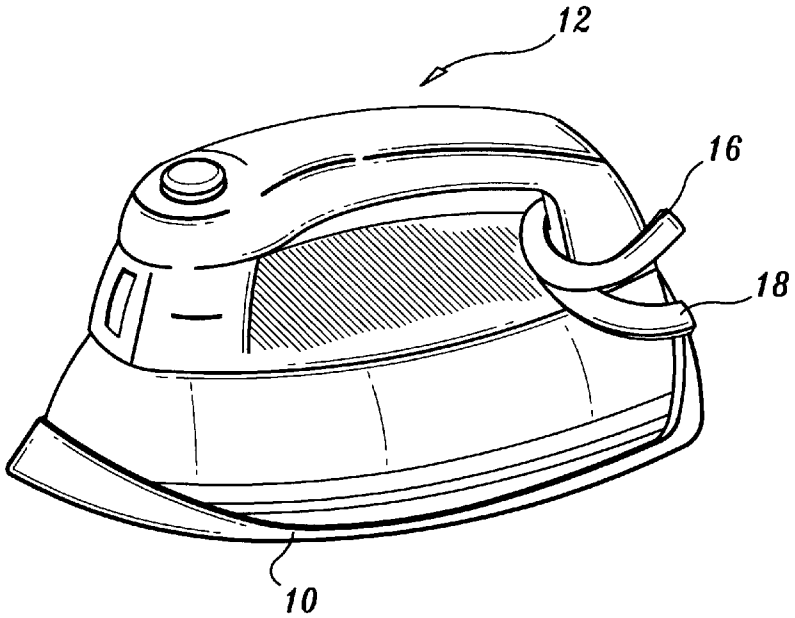
FIG. 1 is a perspective view of an iron with a removably attached cover of a PTFE material.
Figure 3:
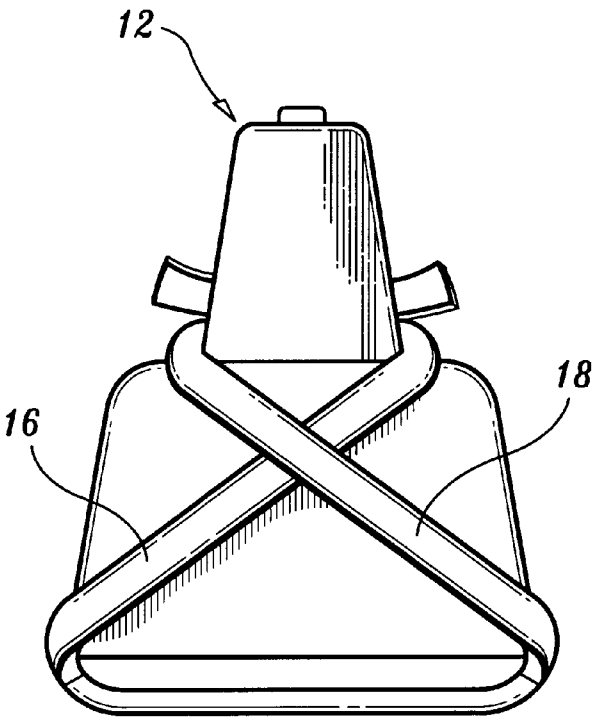
FIG. 3 is a back elevation of the iron with the cover attached.

Referring to FIGS. 1–3, a removable cover 10 for a steam iron 12 is made of a PTFE-type or similar material in flat sheet form that has steam holes 14 formed therethrough in a pattern designed to provide effective delivery of steam to the material being pressed and formed in such a manner as to vertically space the major upper surface of the PTFE material from the sole plate. At its front end, cover 10 has a pocket into which the tip of iron 12 fits, and at its back end cover 12 has two straps 16 and 18 made of a hook-and-loop material that help secure cover 10 to iron 12 as illustrated in FIGS. 1 and 3 and help keep cover 10 in place during ironing.

Figure 2A:
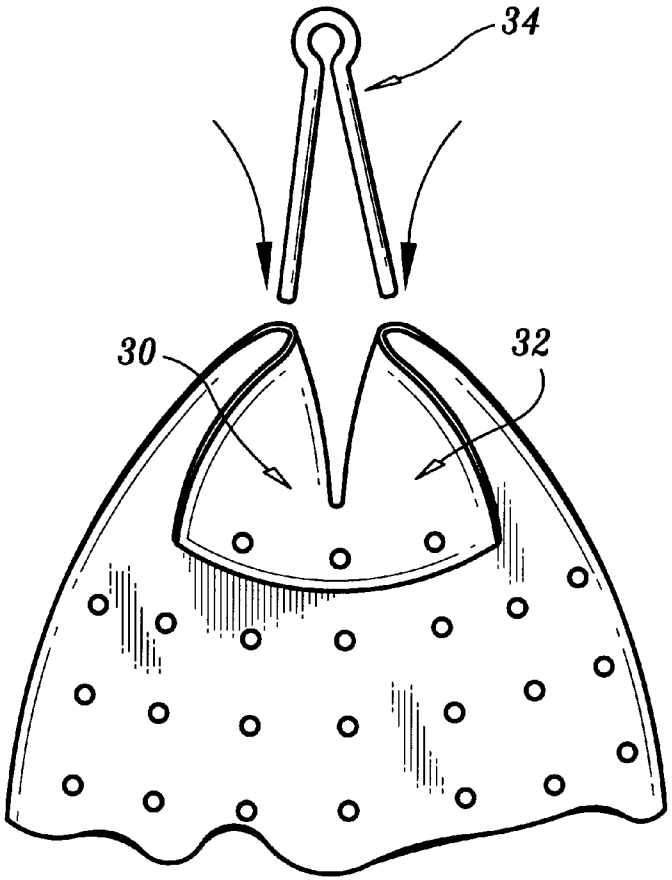
FIG. 2*a* illustrates a step in the assembly of the front of the cover.
Figure 4:
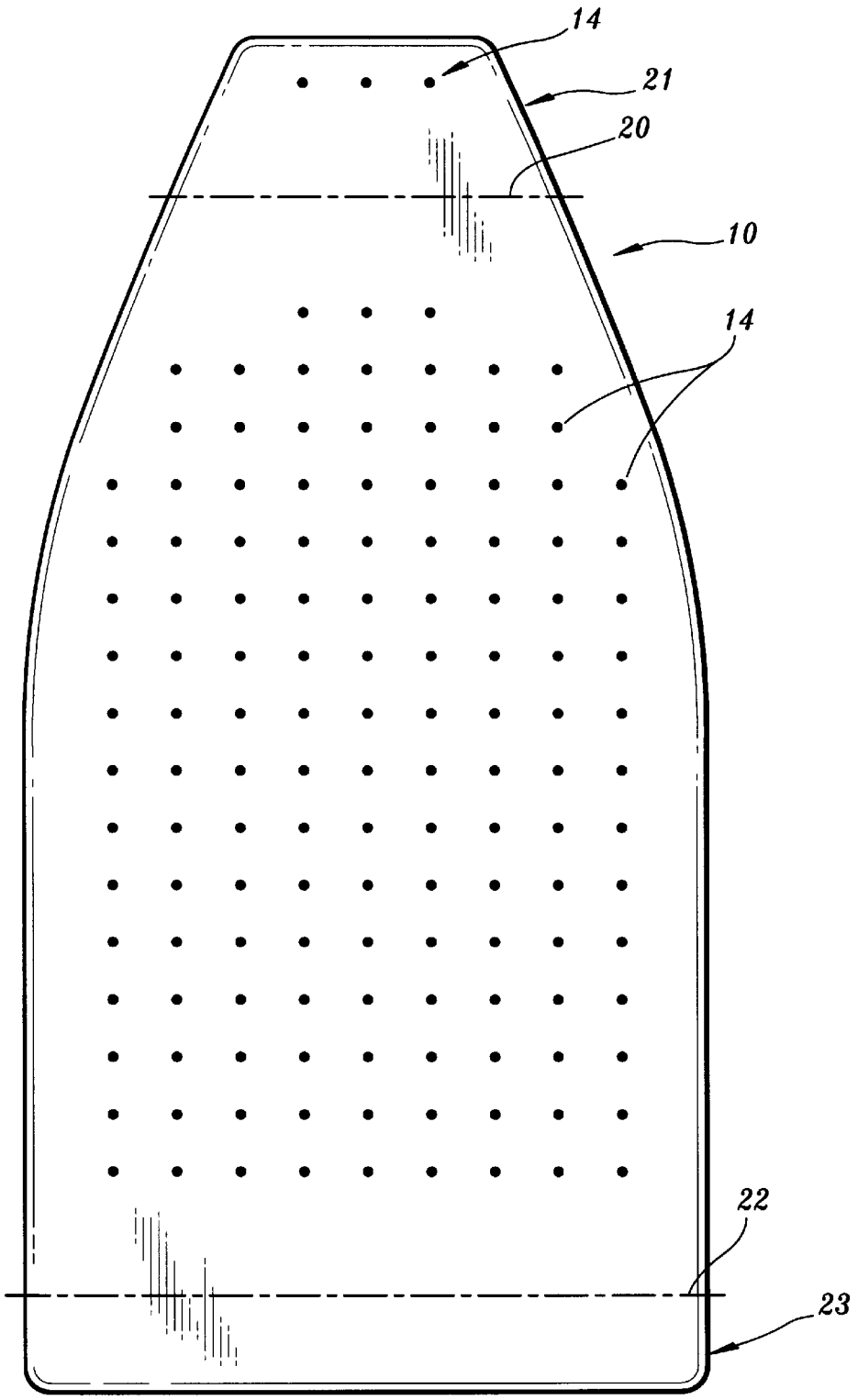
FIG. 4 is a top plan view of sheet PTFE material with a pattern of steam holes.
Figure 5:
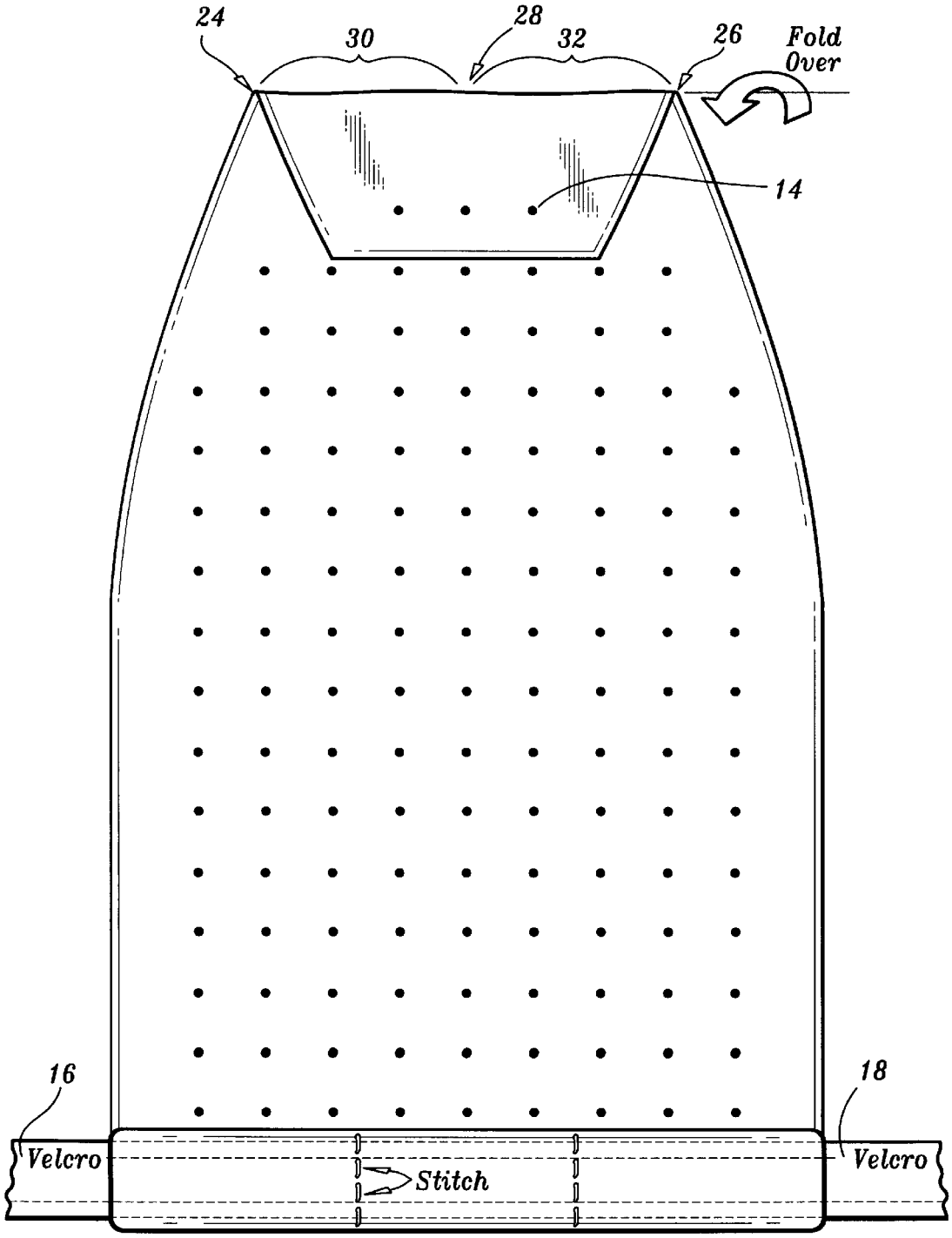
FIG. 5 is a top plan view of the sheet of PTFE material showing a folding line and attached straps.

Referring to FIGS. 4 and 5, cover 10 is cut out of a flat sheet of PTFE-type material to the shape illustrated in FIG. 4, and a pattern of steam holes 14 is punched and stretched to the shape discussed below in connection with FIGS. 6 and 7. While steam holes 14 are in a generally rectangular pattern, other patterns can be used so long as holes 14 are sufficiently close to each other to allow for efficient delivery of steam from the iron to the material being ironed but not so close as to weaken cover 10 structurally or to interfere with the efficient delivery of steam or heat. The relative positions of holes 14 illustrated in FIG. 4 are approximately to scale for a preferred embodiment of the invention. FIG. 4 illustrates a laterally extending fold line 20 at the front of show 10, and three steam holes 14 forward of line 20 positioned such that when the PTFE-type material is folded at line 20, to the position illustrated in FIG. 5, these three holes 14 line up with the three holes which are nearest on the other side of line 20. The portion forward of line 20 forms a flap 21 which, when folded back over the upper surface of the PTFE-type material, to the position illustrated in FIG. 5, helps form a double layer of PTFE-type sheet material at the front of cover 10. At the back of cover 10, there is rear, laterally extending fold line 22 and there is a rear flap 23 behind this fold line 22. Rear flap 23 is folded forwardly at this line 22, over ends of straps 16 and 18, and is stitched to the underlying ends of the straps and the PTFE-type sheet material under the folded over rear flap 23, to hold these ends of straps 16 and 18 securely in place and to help protect them from excessive heat from iron 12 during ironing. To form a pocket for the tip of iron 12, lateral comers 24 and 26 of the folded over front flap 21 are brought together so as to form a point at 28 and bring edges 30 and 32 of the folded over front flap 21 next to each other. Then, a cotter pin 34 or a similarly shaped wire or strip of a metal or other suitable material is inserted between flap 21 and the PTFE sheet material under flap 21 to secure edges 30 and 32 together and thus form a pocket for the iron tip. The tines of cotter pin 34 are sufficiently long to extend from the free end of flap 21 to near fold line 20. For this assembly step, the front end of removable cover 10 is held in a suitable jig which also helps open up the tines of pin 34, to the position illustrated in exaggerated manner in FIG. 2*a*, and the assembled front end assumes the position illustrated in FIG. 2.

To use cover 10 in ironing, the user presses the tip of iron 12 into the pocket at the front end of the cover, positions iron 12 centrally over the remainder of cover 10 (which typically is wider than the iron, as illustrated in FIG. 1), threads the free ends of straps 16 and 18 through the handle of iron 12 as illustrated in FIGS. 1 and 3, and secures them tightly to each other by engaging the free end with hooks to that with loops. Straps 16 and 18 are crossed over at the back of iron 12 as illustrated in FIG. 3, and have hook-and-loop material where they cross so as to better secure cover 10 in place both in the forward stroke and the reverse stroke of iron 12 during ironing.

Figure 7:
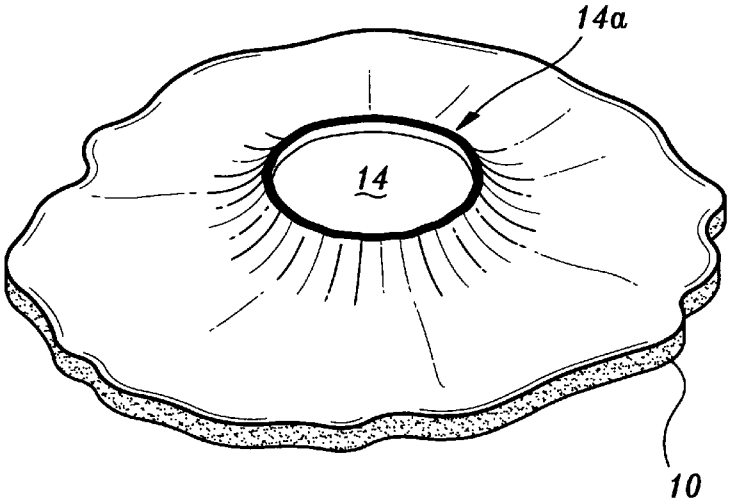
FIG. 7 is a top view illustrating in detail a steam hole in the cover with an irregular upper edge to facilitate steam delivery to the material being ironed.
Figure 6:
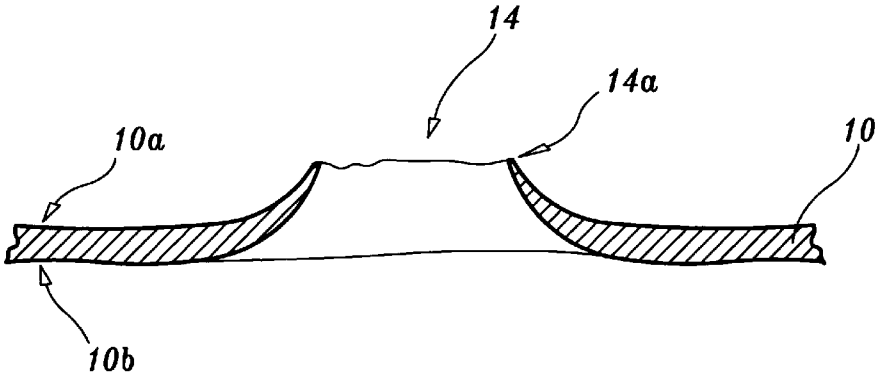
FIG. 6 is a sectional view illustrating the walls of a steam hole in the PTFE material.

Referring to FIGS. 6 and 7, each steam hole 14 is formed by punching and stretching the PTFE-type flat sheet material to the illustrated shape which is wider at the bottom major surface 10*b* of cover 10 than at the top major surface 10*a*. This punching and stretching leaves a protrusion 14*a* which extends above upper major surface 10*a* and helps space top major surface 10*a* from the sole plate of iron 12 for more efficient delivery of steam from the iron's sole plate, through holes 14, to the material being ironed. Further, the punching and stretching process is such that it tends to create an irregular upper edge at the thinner, stretched out portion of the wall of each steam hole 14, as illustrated at 14*b* in FIG. 7, to thereby further help the efficient delivery of steam from iron 12 through holes 14 in cover 10 to the material being ironed.

What is claimed is:

1. A removable cover for a fabric pressing steam iron comprising:

a blank of a PTFE sheet material shaped to correspond to an elongated sole plate of a fabric pressing iron and having: (a) a front flap folded back over the sheet material at a first transverse fold line extending transversely to the length of the blank, and the combination of the folded over front flap and the underlying sheet material folded upwardly at a longitudinal fold line extending centrally along the length of the blank to bring together the forwardmost edges of the fold which is along the first transverse fold line and thereby form a pocket for a tip of the iron; and (b) a back flap folded over the sheet material at a second transverse fold line extending transversely of the length of the blank;

a cotter pin inserted between the front flap and the underlying sheet material such that one tine of the cotter pin is spaced from the other by two thicknesses of the sheet material, one on each side of the transverse fold line, to thereby secure said pocket for the tip of the iron;

a pair of straps of hook-and-loop material each having an end sewn between the back flap and the sheet material underlying the back flap, and each having a free end extending laterally away from the blank in a direction opposite that of the other flap, said straps being sufficiently long to loop through a handle of the iron and be secured to each other by hook-and-loop engagement, to thereby removably secure the cover to the iron;

said blank being made of a generally flat sheet material but having a pattern of steam holes punched and stretched into the blank such that each forms a protuberance extending from the blank toward the iron when the cover is secured to the iron and vertically spacing at least central portions of the cover from the iron.

2. A removable cover for a fabric pressing iron as in claim 1 in which the steam holes in the blank are substantially wider at their bottom ends than at their top ends and a plurality have irregular edges at their top ends.

3. A removable cover for a fabric pressing iron as in claim 2 in which the top ends of a plurality of the steam holes have ragged edges.

4. A removable cover for a fabric pressing steam iron comprising:

a sheet of a flexible, heat resistant and slippery material shaped to correspond to an elongated sole plate of a fabric pressing iron and having a front flap and a rear flap folded over the underlying sheet material at a first and a second laterally extending fold line, respectively;

the front flap and the sheet material thereunder being folded up toward each other along a central longitudinally extending fold line so that the front fold line forms two equal portions extending along straight lines next to each other and thus form a pocket for a tip of the iron;

a fastener securing the pocket to maintain the two portions of the front fold line next to each other during use of the iron with the cover attached thereto;

a pair of straps secured to the rear flap and the sheet material underlying the rear flap and extending laterally away from the sheet material and having sufficient lengths to cross over each other and wrap through a handle of the iron, said straps having free ends removable securable to each other to thereby maintain the cover secured to the iron;

said sheet material being generally flat but having a pattern of steam holes forming protuberances extending from the blank toward the iron when the cover is secured to the iron and vertically spacing at least central portions of the cover from the iron.

5. A removable cover for a fabric pressing iron as in claim 4 in which the steam holes in the sheet material are substantially wider at their bottom ends than at their top ends.

6. A removable show for a fabric pressing iron as in claim 4 which a plurality of the steam holes in the sheet material have irregular edges at their top ends.

7. A removable cover for a fabric pressing iron as in claim 5 in which a plurality of the steam holes in the sheet material have ragged top edges.

8. A method of making a cover for a fabric pressing iron comprising the steps of:

providing flat sheet material which is heat resistant and slippery and cutting a blank therefrom which generally matches the outline of the sole plate of a fabric pressing iron;

punching and stretching a pattern of steam holes in a central area of the blank to form, from the flat sheet material, protuberances at the outlines of the steam holes which extend up from an otherwise flat major upper surface of the blank;

folding a rear flap of the blank forwardly over the blank and securing between the folded over rear flap and the blank a pair of straps extending from the blank laterally in opposite directions;

folding a front flap back over the blank, and folding up the folded over front flap together with the portion of the blank thereunder along a central, longitudinally extending fold line to bring alongside each other two portions of the forward edge of the folded over front flap, one on each side of the longitudinally extending fold line; and securing the brought together forward edges of the front flap to each other to form a pocket for a tip of the iron.

9. A method as in claim 8 in which the step of securing the forward edges of the front flap to each other comprises inserting one tine of a cotter pin between the front flap and the blank material thereunder on one side of the longitudinal fold line and the other tine of the cotter pin between the front flap and the blank at the other side of the longitudinal fold line such that the tines extend parallel to said two portions of the forward edge of the folded over front flap.

10. A method as in claim 8 in which the step of punching and stretching a pattern of holes in the blank comprises forming a plurality of holes to have irregular upper edges.

* * * * *